US008577267B2

(12) United States Patent
Tong

(10) Patent No.: US 8,577,267 B2
(45) Date of Patent: Nov. 5, 2013

(54) TRANSPARENT INTERMEDIATE TRANSFER MEMBERS CONTAINING ZINC OXIDE, POLYARYLSULFONE, AND POLYETHERAMINE

(75) Inventor: Yuhua Tong, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 478 days.

(21) Appl. No.: 12/947,221

(22) Filed: Nov. 16, 2010

(65) Prior Publication Data

US 2012/0119160 A1 May 17, 2012

(51) Int. Cl.
*G03G 15/20* (2006.01)
*B41M 5/42* (2006.01)

(52) U.S. Cl.
USPC ..... 399/308; 399/176; 399/279; 399/286; 399/297; 428/32.69; 428/32.74; 428/32.86; 252/500; 252/511; 252/512

(58) Field of Classification Search
USPC ..... 430/58.8, 60, 66, 132; 252/500, 511, 252/512; 428/32.69, 32.74, 32.86; 399/176, 399/279, 286, 297, 308
See application file for complete search history.

(56) References Cited

U.S. PATENT DOCUMENTS

| | | | | |
|---|---|---|---|---|
| 5,248,826 | A * | 9/1993 | Sasaki et al. | 564/307 |
| 5,487,707 | A | 1/1996 | Sharf et al. | |
| 6,139,784 | A | 10/2000 | Oshima et al. | |
| 6,318,223 | B1 | 11/2001 | Yu et al. | |
| 6,397,034 | B1 | 5/2002 | Tarnawskyj et al. | |
| 6,440,515 | B1 | 8/2002 | Thornton et al. | |
| 6,602,156 | B2 | 8/2003 | Schlueter, Jr. | |
| 7,031,647 | B2 | 4/2006 | Mishra et al. | |
| 7,309,551 | B2 * | 12/2007 | Tong et al. | 430/66 |
| 7,476,479 | B2 * | 1/2009 | Tong et al. | 430/60 |
| 8,361,631 | B2 * | 1/2013 | Wu | 428/500 |
| 2006/0029872 | A1 * | 2/2006 | Qi et al. | 430/58.8 |
| 2007/0116976 | A1 * | 5/2007 | Tan et al. | 428/546 |

OTHER PUBLICATIONS

Greene et al., "Solution-Grown Zinc Oxide Nanowires", Inorganic Chemistry Article, 2006, vol. 45, No. 19, pp. 75357543.

* cited by examiner

*Primary Examiner* — Mark Kopec
*Assistant Examiner* — Haidung Nguyen
(74) *Attorney, Agent, or Firm* — Eugene O. Palazzo

(57) ABSTRACT

An intermediate transfer member including an optional supporting substrate, and in contact with the supporting substrate in the configuration of a layer a polyarylsulfone, a polyetheramine, and nano-size zinc oxide particles.

20 Claims, 1 Drawing Sheet

TRANSPARENT INTERMEDIATE TRANSFER MEMBERS CONTAINING ZINC OXIDE, POLYARYLSULFONE, AND POLYETHERAMINE

This disclosure is directed to a transparent intermediate transfer member useful in electrophotographic, including digital, machines. The intermediate transfer member includes nano-size zinc oxide particles present in a mixture of a polyetheramine and a polyarylsulfone.

BACKGROUND

A number of problems are associated with intermediate transfer members, such as belts. For example, their black color results in minimal or substantially no optical properties, which in turn adversely impacts visual observation of defects. The lack of transparency also does not readily enable the identification of bubbling during the preparation and manufacturing of the intermediate transfer members. This bubbling causes xerographic image defects and poor image resolution. It is also difficult to monitor the cleaning of residual toner from non-transparent intermediate transfer members. There has also been a problem in enabling the economical formation of suitable stable dispersions with minimum settling of solids, when conductive fillers of carbon black, metal, or metal oxides are used in amounts exceeding about 20 percent by weight. These and other problems are minimized or substantially eliminated with the synergistic effect of nano-size zinc oxide and a polyetheramine.

Thus, there is a need for a transparent intermediate transfer member with excellent transfer capabilities, and suitable conductivity in the absence of, or with a minimum amount of carbon black or similar conductive materials.

Further, there is a need for transparent intermediate transfer members (ITM) that have excellent wear and abrasion resistance, excellent mechanical properties, and which primarily because of the ITM optical density permits one to visually observe any defects in the members, and permits the use of a number of different forms of light sources to detect bubbling, settling of solids and other defects in the ITM.

There is also a need for a process to incorporate zinc oxide, a semiconductor, that is difficult to uniformly disperse, into a polymeric material.

These and other needs are achievable in embodiments of the present disclosure.

FIGURES

There are provided the following Figures to further illustrate the intermediate transfer members disclosed herein.

SUMMARY

Disclosed is a transparent intermediate transfer member comprising a layer of nano-size zinc oxide present in a mixture of a polyarylsulfone, and a polyetheramine.

Also disclosed is a transparent intermediate transfer member comprising a supporting substrate and a layer thereover comprising in situ nano-size zinc oxide particles having a diameter of from about 50 to about 250 nanometers dispersed in a mixture of a polyetheramine and a polyphenylsulfone.

In embodiments of the present disclosure there is illustrated a transparent intermediate transfer member comprising a supporting substrate, a layer thereover comprising a mixture of in situ nano-size zinc oxide particles having a diameter of from about 100 to about 250 nanometers dispersed in a mixture of a polyetheramine and a polyphenylsulfone, and in contact with the in situ nano-sized zinc oxide mixture a release layer.

EMBODIMENTS

There is provided herein a transparent intermediate transfer member comprising an optional supporting substrate, and thereover a layer or film comprising nano-sized zinc oxide particles present in a mixture of a polyarylsulfone and polyetheramine binder.

Figure 1:
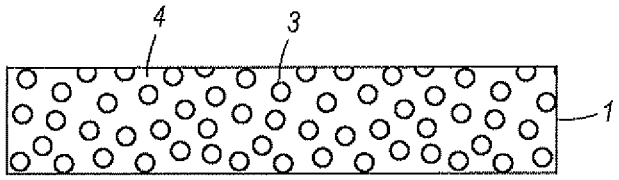
FIG. 1 illustrates an exemplary embodiment of an intermediate transfer member of the present disclosure.
Figure 2:
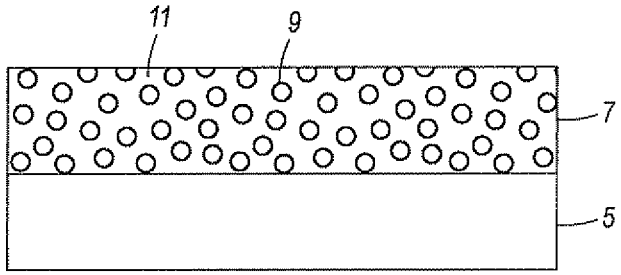
FIG. 2 illustrates an exemplary embodiment of an intermediate transfer member of the present disclosure.
Figure 3:
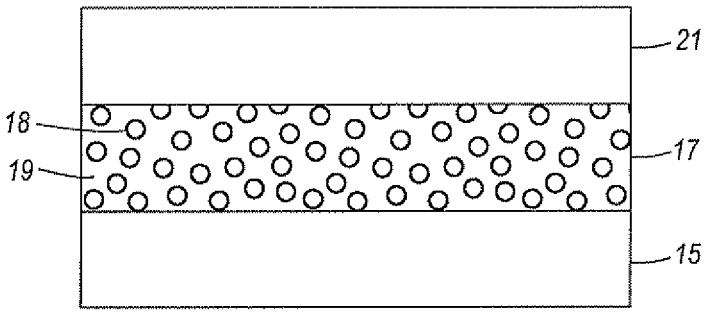
FIG. 3 illustrates an exemplary embodiment of an intermediate transfer member of the present disclosure.

Exemplary and non-limiting examples of the intermediate transfer members according to embodiments of the present disclosure are depicted in FIGS. 1, 2, and 3.

In FIG. 1 there is illustrated an intermediate transfer member comprising a layer 1 comprising nano-sized in situ zinc oxide particles 3 dispersed in a mixture of a polyarylsulfone and a polyetheramine 4.

In FIG. 2 there is illustrated an intermediate transfer member comprising a supporting substrate 5, and a layer 7 containing nano-sized in situ zinc oxide particles 9 dispersed in a mixture of a polyarylsulfone, and a polyetheramine 11.

In FIG. 3 there is illustrated an intermediate transfer member comprising a supporting substrate 15, a layer 17 containing nano-sized in situ zinc oxide particles 18 dispersed in a mixture of a polyarylsulfone, and a polyetheramine 19, and a release layer 21.

In various aspects of the present disclosure, the intermediate transfer members include nano-sized zinc oxide of a diameter of from about 0.15 Angstrom to about 225 nanometers, from about 50 nanometers to about 250 nanometers, from about 100 nanometers to about 200 or about 250 nanometers, or from about 100 nanometers to about 150 or about 175 nanometers, and other diameters as illustrated herein, where the diameter is determined by known analytical methods, such as by an electron microscope. Also included herein is a polyarylsulfone of, for example, a polyphenylsulfone, a polynaphthylsulfone or a polyanthrylsulfone, having a weight average molecular weight of from about 100 to about 125,000, from about 1,000 to about 100,000, from about 5,000 to about 90,000, or from about 50,000 to about 75,000; and a polyetheramine having a weight average molecular weight of from about 500 to about 100,000, from about 1,000 to about 75,000, or from about 5,000 to about 75,000, the weight average molecular weights being determined by GPC analysis.

In addition, the intermediate transfer members can optionally include a supporting substrate of a polyimide, and/or an outer release layer positioned on the polyphenylsulfone, polyetheramine, and the nano-sized zinc oxide layer, the release layer comprising a fluorinated ethylene propylene copolymer, a polytetrafluoroethylene, a polyfluoroalkoxy polytetrafluoroethylene, a fluorosilicone, a terpolymer of vinylidene fluoride, hexafluoropropylene, and tetrafluoroethylene, or mixtures thereof. VITON®s are tetrapolymers of vinylidene fluoride, tetrafluoroethylene, and a cure site monomer.

Transparent, or transparency refers to intermediate transfer members that have a substantial absence of light absorption as visually observed, and where the member's transparency is determined by the amount of light absorbed. Transparency refers to the member absorbing less than about 90 percent, or less than about 80 percent, or less than about 75 percent of light, in the wavelength region of from about 400 to about 1,000 nanometers or from about 500 to about 800 nanometers. For example, the absorbance can be from about 20 to about 90 percent, from about 20 to about 80 percent, or from about 20 to about 75 percent in the wavelength region of from about 400 to about 1,000 nanometers, or from about 500 to about 800 nanometers. The transparency is provided, in embodiments, by completely excluding or by using minimum amounts of non-transparent fillers, such as carbon black, that are conventionally used in a number of known intermediate transfer members.

The process for the preparation of the transparent intermediate transfer members disclosed herein generally comprises mixing a polymer material, such as a polyarylsulfone, a zinc salt such as zinc acetate, and a polyetheramine in a solvent; heating the mixture at a temperature of, for example, from about 50 to about 100, from about 65 to about 95, or from about 75° C. to about 90° C. to form a substantially stable mixture of zinc hydroxide resulting from a reaction of the zinc salt and the amino groups of the polyetheramine particles; depositing the resulting mixture on a substrate, such as a suitable polymer or a suitable metal like stainless steel; and heating at, for example, a temperature of from about 110° C. to about 400° C., from about 125° C. to about 300° C., or from about 125° C. to about 195° C. or about 225° C. to dehydrate the zinc hydroxide particles to form in situ nano-size zinc oxide particles dispersed in a mixture of a polyetheramine and a polyarylsulfones. It is believed that the nano-sized zinc oxide particles and the polyetheramine possess synergistic characteristics, especially with regard to controlling, or improving, the conductivity of the intermediate transfer member.

This disclosure also provides a process for preparing an intermediate transfer member comprising mixing a polyarylsulfone, a zinc salt of zinc acetate, and a polyetheramine in a solvent; heating the mixture at about 100° C., followed by depositing the mixture resulting on a metal substrate, then accomplishing a second heating at above 100° C. as illustrated herein to form in situ nano-size zinc oxide particles dispersed in a mixture of the polyarylsulfone and the polyetheramine.

While not be desired to be limited by theory, it is believed that the amino groups of the polyetheramine forms a temporary complex with zinc ions and/or zinc hydroxide at the molecular level where the particle size was not readily measurable, which upon heating as illustrated herein causes the complex to decompose to form in situ nano-sized zinc oxide particles. During the heating, the polyetheramine returns to its original state present in the amount as initially added prior to the reaction described herein, and resulting in nano-sided zinc oxide particles present or dispersed in a binder mixture of a polyarylsulfone and polyetheramine. The nano-size zinc oxide particles can be formed as illustrated in an article authored by Lori E. Greene, Benjamin D. Yuhas, Matt Law, David Zitoun, and Peidong Yang, in *Inorganic Chemistry,* 2006, 45 (19), on for example, pages 7,535 to 7,543, the disclosure of this article being totally incorporated herein by reference.

Process of Making

The transparent members can be prepared by mixing and reacting a zinc acetate hydrate or dehydrate, and a polyetheramine, such as JEFFAMINE™ ED-2003 (a polyetheramine water soluble aliphatic diamine derived from a propylene oxide capped polyethylene glycol, and available from Huntsman Corporation) in a solvent to form a dispersion, and adding the dispersion to a polyarylsulfone binder. The dispersion, which is somewhat stable up to about 100° C., comprises a complex of zinc or zinc oxide and the amino groups of the polyetheramine where eventually the polyetheramine is present in a residual amount, or more than a residual amount as indicated herein. When heating the dispersion above about 100° C., such as about 110° C. to about 400° C., from about 125° C. to about 225° C., about 125° C. to about 200° C., or about 195° C., or other temperatures as illustrated herein, the complex disassociates, and there is formed in situ nano-sized zinc oxide particles, present in a mixture of a polyetheramine and a polyarylsulfone binder.

With known milling processes, uniform dispersions of the intermediate transfer member coating mixture of the nano-sized zinc oxide formed in situ, the polyetheramine binder and the polyarylsulfone binder, can be deposited on a suitable substrate, such as a metal substrate like stainless steel using any suitable method such as a draw bar coating method. The resulting individual film or films can be dried at high temperatures, such as 110° C. as illustrated herein, for a suitable period of time, such as from about 20 to about 180 minutes, or from about 40 to about 120 minutes, while remaining on the metal substrates. After drying and cooling to room temperature, about 23° C. to about 25° C., the films resulting can be removed from the metal substrates by known processes, such as by hand peeling, and there results for example, in embodiments, from about 50 to about 150, from about 75 to about 100 microns, or from about 25 to about 50 thick films that function as intermediate transfer members. Also, the films obtained can be deposited on supporting substrates, such as a polyimide, to form a multi-layer final structure.

The nano-size zinc oxide particles assist in enabling conductive intermediate transfer members while simultaneously allowing for their transparency. Thus, for example, zinc oxide particles larger than a certain diameter tend to progressively decrease the transparent characteristics of the members; the larger the diameter of the zinc oxide particles above nano-size results in a decrease in the transparency of the members.

The polyetheramine can assist in providing transparent intermediate transfer members with antistatic properties. Further, the amino groups of the polyetheramine compounds selected as illustrated herein enable, it is believed, a synergetic effect with zinc oxide. It is also believed that the polyetheramines have a weak or poor capability of anti-static characteristics under high humidity conditions, such as for example, above about 50 percent relative humidity as measured with a known humidity weather device. When the polyetheramine and the nano-size zinc oxide particles are mixed at the molecular level, the electrical conductivity of the obtained composited material can be enhanced.

Also, for intermediate transfer member applications, the use of reduced amounts of conducitve fillers, like carbon black, such as less than about 20, such as from about 1 to about 10 weight percent permit the achievement of an acceptable to excellent surface conductivity and enable flexibility for the intermediate transfer members. Thus, for example, the surface resistivity of the disclosed intermediate transfer members is, for example, from about $10^9$ to about $10^{13}$ ohm/square, or from about $10^{19}$ to about $10^{12}$ ohm/square measured as illustrated herein. The sheet resistivity of the intermediate transfer member is, for example, from about $10^7$ to about $10^{13}$ ohm/square, from about $10^8$ to about $10^{12}$ ohm/square, or from about $10^{10}$ or about $10^9$ to, or about $10^{11}$ or about $10^{12}$ ohm/square determined as illustrated herein.

An additional feature of the disclosure is that the coating composition used to form the transparent conductive layer can be provided as a stable dispersion that has an extended pot life. In this dispersion, settling and agglomeration of solids from the solution can be avoided or minimized. The dispersion exhibits a functional resistivity as illustrated herein, a high modulus of from about 3,000 to about 8,000 MPa or from about 4,500 to about 6,500 MPa, a glass transition temperature ($T_g$) of from about 275° C. to about 395° C. or from about 325° C. to about 375° C., and a CTE (coefficient of thermal expansion) of from about 25 to about 75 ppm or from about 35 to about 55 ppm.

Polyarylsulfone

Any suitable polyarylsulfone can be used as the film-forming or binder polymer material for forming the layer with the in situ zinc oxide particles and polyetheramine. For example, suitable polyarylsulfones include those where the aryl group contains from 6 to about 18 carbon atoms or from 6 to about 12 carbon atoms, such as polyphenylsulfone, polynaphthylsulfone, and polyanthrylsulfone. These materials can have a weight average molecular weight of, for example, from about 100 to about 125,000, from about 1,000 to about 120,000, or from about 10,000 to about 100,000, as determined by GPC analysis. Examples of suitable polyarylsulfones selected for the intermediate transfer members, and more specifically, for the conductive transparent mixture disclosed herein include, for example, RADEL™, UDEL™, VERADEL™, all available from Solvay Plastics, and ULTRASON™ S and ULTRASON™ E, all available from BASF.

The polyarylsulfone can be present in any desired or effective amount, such as from about 25 to about 99 weight percent, from about 45 to about 90 weight percent, or from about 50 to about 90 weight percent, or from about 55 to about 85 weight percent, based on a total weight of the dried layer.

Polyetheramine

Any suitable polyetheramine can also be used to interact with the zinc salt to form the layer with the in situ nano-sized zinc oxide particles. For example, suitable polyetheramines can have a weight average molecular weight of ($M_w$), for example, from about 500 to about 100,000, from about 1,000 to about 90,000, or from about 10,000 to about 80,000, as determined by GPC analysis. Examples of polyetheramines selected include the JEFFERAMINE™ M series, D series, ED series, EDR series, T series, XTJ series and SD series, all available from Huntsman Petrochemical Corporation.

The polyetheramine can be present in any desired or effective amount such as from about 0.1 to about 20 weight percent, from about 0.5 to about 15 weight percent, or about 1 to about 5 or about 10 weight percent, based on a total weight of the dried layer components, and after heating to above about 100° C.

Zinc Salts

Zinc salts that may be selected for the reaction of such salts with the polyetheramine as illustrated herein are, for example, zinc acetate, zinc chloride, zinc bromide, zinc fluoride, zinc iodide, zinc sulfide, zinc nitrate, and other related similar salts. Zinc acetate is particularly useful, in embodiments, due to its ease of reaction with the polyetheramine. The zinc salts can be selected in various amounts as illustrated herein, such as, for example, from about 1 to about 60 weight percent, from 1 to about 40 percent, or from 3 to about 18 percent of the dispersion mixture excluding solvent. In the final formed layer, the resultant zinc oxide can be present in any desired or effective amount. For example, the zinc oxide can be present in an amount of from about 0.1 to about 20 weight percent, from about 0.5 to about 15 weight percent, or from about 1 to about 10 weight percent, based on a total weight of the dried layer.

Suitable solvents useful for forming the coating composition used to form the transparent, conductive layer include any of the various solvents generally used in the art for forming intermediate transfer member mixtures. For example, suitable solvents include organic solvents, such as N-methylpyrrolidone, alkylene halides such as methylene chloride, tetrahydrofuran, toluene, monochlorobenzene, N-methyl-2-pyrrolidone, N,N-dimethylformamide, N,N-dimethylacetamide, methyl ethyl ketone, methyl isobutyl ketone, mixtures thereof, and the like.

Optional Second Filler

A second filler, in addition to the zinc oxide, may also be included in the coating composition used to form the transparent, conductive layer, if desired. Examples of suitable second fillers include carbon black, a metal oxide, or a polyaniline. The second filler can be present in the coating composition in amounts as illustrated herein, such as for example, an amount of from about 1 to about 10 weight percent, from about 1 to about 7 weight percent, or from about 1 to about 5 weight percent.

Examples of carbon blacks selected as the second filler for the intermediate transfer mixture, and for the intermediate transfer members disclosed herein include VULCAN® carbon blacks, REGAL® carbon blacks, MONARCH® carbon blacks, and BLACK PEARLS® carbon blacks available from Cabot Corporation. Desirable, however, carbon black is absent or its presence is minimized, in order to promote transparency of the intermediate transfer member. While an advantage of the present disclosure is that the use of carbon black can be avoided, small amounts of carbon black can be added, for example, to assist in adjusting the conductivity of the layer.

Polyaniline second fillers that may be selected include PANIPOL™ F, commercially available from Panipol Oy, Finland; and known lignosulfonic acid grafted polyanilines. These polyanilines usually have a relatively small particle size diameter of, for example, from about 0.5 to about 5 microns, from about 1.1 to about 2.3 microns, from about 1.2 to about 2 microns, from about 1.5 to about 1.9 microns, or about 1.7 microns. The second filler can be present in the coating composition in, for example, an amount of from about 1 to about 10 weight percent, from about 1 to about 7 weight percent, or from about 1 to about 5 percent.

Examples of metal oxides selected as the second filler include, for example, tin oxide, antimony doped tin oxide, indium oxide, indium doped tin oxide, zinc oxide, and titanium oxide, and the like. The second filler can be present in the coating composition in, for example, an amount of from about 1 to about 10 weight percent, from about 1 to about 7 weight percent, or from about 1 to about 5 percent.

Layered Structures

The intermediate transfer members of the present disclosure can be in the form of a single layer, or in the configurations of two or more layers.

For the single layered configuration, the intermediate transfer members comprise nano-sized zinc oxide particles present or dispersed in a mixture of a polyarylsulfone and a polyetheramine. This structure is shown in FIG. 1, which depicts an embodiment of an intermediate transfer member 1 having a single layer 2 of nano-sized zinc oxide particles present in a mixture of a polyarylsulfone and a polyetheramine.

Dual layered intermediate transfer members comprise a supporting substrate layer, and present on the supporting substrate a layer comprising nano-sized zinc oxide particles present in a mixture of a polyarylsulfone and a polyetheramine. This structure is shown in FIG. 2, which depicts an embodiment of an intermediate transfer member 11 having a supporting substrate 12, and the layer 13 of nano-sized zinc oxide particles present in a mixture of a polyarylsulfone and a polyetheramine.

The three layered transparent intermediate transfer members include a supporting substrate, a layer thereover of in situ nano-sized zinc oxide particles dispersed in a mixture of a polyarylsulfones and a polyetheramine, and a third layer thereover that assists in permitting release of the xerographic image thereon to a substrate. This structure is shown in FIG. 3, which depicts an embodiment of an intermediate transfer member 21 having a supporting substrate 22, a layer 23 of nano-sized zinc oxide particles present in a mixture of a polyarylsulfone and a polyetheramine, and an outer release layer 24.

Supporting Substrate

The substrate of a thickness of from about 10 to about 300 microns, from 50 to about 150 microns, and from 75 to about 125 microns can comprise a metal, such as stainless steel, aluminum, nickel, copper, and their alloys, and such substrates can be in the form of a flexible belt, a flat sheet, or a rigid drum.

There can also be used as supporting substrates polyamideimides of a thickness, for example, of from about 10 to about 300 microns, from 50 to about 150 microns, and from 75 to about 125 microns, and which polyamideimides can be selected from the group consisting of

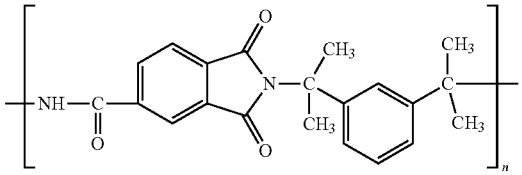

;

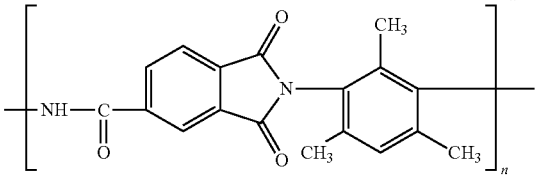

;

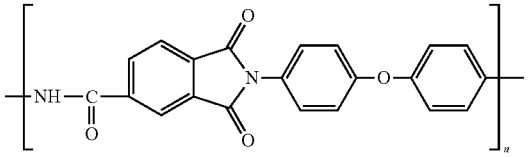

and

-continued

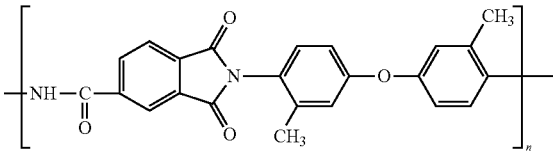

where n represents the number of repeating segments, and can be a number thereof of from about 100 to about 500, or from about 200 to about 400. In embodiments, the polyamideimides illustrated herein, and other polyamideimides that can be selected as the supporting substrate are commercially available from Toyobo Company, and can be synthesized by at least the following two known methods: (1) the isocyanate method, which involves the reaction between an isocyanate and trimellitic anhydride; or (2) the acid chloride method, where there is reacted a diamine and trimellitic anhydride chloride. Thus, with the first method, (1) when more than one, such as two, three or four, isocyanates are selected to react with a trimellitic anhydride, a polyamideimide copolymer is formed, and which copolymer can be included in the intermediate transfer member; and with (2) when more than one, such as two or three acid chlorides are selected to react with a trimellitic anhydride chloride, a polyamideimide copolymer is formed, and which copolymer can also be included in the disclosed intermediate transfer member. Additionally, polyamideimide homopolymers, polyamideimide copolymers, and their blends can also be included in the disclosed intermediate transfer members disclosed herein.

Commercially available or obtainable examples of the polyamideimide supporting substrates include VYLOMAX® HR-11NN (15 weight percent solution in N-methylpyrrolidone, Tg=300° C., and $M_w$=45,000), HR-12N2 (30 weight percent solution in N-methylpyrrolidone/xylene/methyl ethyl ketone=50/35/15, Tg=255° C., and $M_w$=8,000), HR-13NX (30 weight percent solution in N-methylpyrrolidone/xylene=67/33, $T_g$=280° C., and $M_w$=10,000), HR-15ET (25 weight percent solution in ethanol/toluene=50/50, $T_g$=260° C., and $M_w$=10,000), HR-16NN (14 weight percent solution in N-methylpyrrolidone, $T_g$=320° C., and $M_w$=100,000), HR-66NN (13 weight percent solution in N-methylpyrrolidone, $T_g$=340° C.), all commercially available from Toyobo Company of Japan, and TORLON® Al-10 ($T_g$=272° C.), commercially available from Solvay Advanced Polymers, LLC, Alpharetta, Ga.

Examples of specific polyimide supporting substrates selected for the intermediate transfer members disclosed herein include, in embodiments, KAPTON® KJ, commercially available from E.I. DuPont, Wilmington, Del., as represented for example by

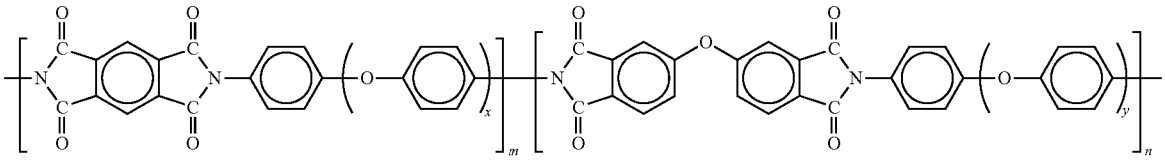

wherein x represents the number of groups, such as from about 2 to about 4; y represents the number of groups of from about 2 to about 4; m and n are from about 10 to about 300, or from about 50 to about 200, or from about 100 to about 195; and IMIDEX®, commercially available from West Lake Plastic Company.

The intermediate transfer member present in the imaging systems illustrated herein may be in the configuration of a sheet, a web, a belt, including an endless belt, and an endless seamed flexible belt; a roller, a film, a foil, a strip, a coil, a cylinder, a drum, an endless strip, and a circular disc. The intermediate transfer member can be comprised of a single layer, or can be comprised of several layers, such as from about 2 to about 5 layers. The circumference of the intermediate transfer member, especially as it is applicable to a film or a belt configuration, is, for example, from about 275 to about 2,700 millimeters, from about 1,700 to about 2,600 millimeters, or from about 2,000 to about 2,200 millimeters with a corresponding width of, for example, from about 100 to about 1,000 millimeters, from about 200 to about 500 millimeters, or from about 300 to about 400 millimeters.

Outer Release Layer

In embodiments, the intermediate transfer member may be of a three-layer configuration, see FIG. 3, and further include an optional outer release layer in contact with the layer of the in situ nano-sized zinc oxide present in a mixture of a polyetheramine and a polyarylsulfone polyarylsulfone. Release layer examples situated on and in contact with the outer layer include materials as illustrated herein, and more specifically, TEFLON®-like materials including fluorinated ethylene propylene copolymer (FEP), polytetrafluoroethylene (PTFE), polyfluoroalkoxy polytetrafluoroethylene (PFA TEFLON®), and other TEFLON®-like materials; silicone materials, such as fluorosilicones and silicone rubbers, such as Silicone Rubber 552, available from Sampson Coatings, Richmond, Va., (polydimethyl siloxane/dibutyl tin diacetate, 0.45 gram DBTDA per 100 grams polydimethyl siloxane rubber mixture, with a molecular weight $M_w$ of approximately 3,500); and fluoroelastomers, such as those sold as VITON® (a trademark of DuPont), such as copolymers and terpolymers of vinylidenefluoride, hexafluoropropylene, and tetrafluoroethylene, which are known commercially under various designations as VITON A®, VITON E®, VITON E60C®, VITON E45®, VITON E430®, VITON B910®, VITON GH®, VITON B50®, VITON E45®, and VITON GF®. The VITON® designation is a trademark of E.I. DuPont de Nemours, Inc. Two known fluoroelastomers selected for the release layer are comprised of (1) a class of copolymers of vinylidenefluoride, hexafluoropropylene, and tetrafluoroethylene, known commercially as VITON A®; (2) a class of terpolymers of vinylidenefluoride, hexafluoropropylene, and tetrafluoroethylene, known commercially as VITON B®; and (3) a class of tetrapolymers of vinylidenefluoride, hexafluoropropylene, tetrafluoroethylene, and a cure site monomer (these are the ones usually used, so you would want to change the above to the tetrapolymer), such as VITON GF®, having about 35 mole percent of vinylidenefluoride, about 34 mole percent of hexafluoropropylene, about 29 mole percent of tetrafluoroethylene with about 2 percent cure site monomer. The cure site monomer can be those available from E.I. DuPont de Nemours, Inc. such as 4-bromoperfluorobutene-1,1,1-dihydro-4-bromoperfluorobutene-1,3-bromoperfluoropropene-1,1,1-dihydro-3-bromoperfluoropropene-1, or any other suitable known commercially available cure site monomers.

The release layer or layers may be deposited on the layer of the polyarylsulfone, polyetheramine, and in situ zinc oxide layer by known coating processes. Known methods for forming the outer release layer include dipping, spraying such as by multiple spray applications of very thin films, casting, flow-coating, web-coating, roll-coating, extrusion, molding, or the like. Usually it is desirable to deposit the layers by spraying, such as by multiple spray applications of very thin films, casting, by web coating, by flow-coating, and more specifically, by laminating.

Specific embodiments and Examples will now be described. These Examples are intended to be illustrative, and are not limited to the materials, conditions, or process parameters set forth in these embodiments. All parts are percentages by weight of total solids unless otherwise indicated.

COMPARATIVE EXAMPLE 1

Preparation of Carbon Black Dispersion

A dispersion was prepared by mixing Special Black 4 powder obtained from Evonik Degussa, 2.17 grams, with 20 grams of the polyphenylsulfone ULTRASON™ P3010 as obtained from BASF, and 514 grams of the solvent N-methylpyrrolidone (NMP). The resulting mixture was homogenized in a glass container at 4,000 rpm for 2 hours, followed by cooling to room temperature, about 25° C.

Example I

A second dispersion was prepared by repeating the process of Comparative Example 1 except that carbon black was not used and instead there was added to the dispersion the polyetheramine JEFFAMINE® ED-2003, a water soluble aliphatic diamine derived from a propylene oxide capped polyethylene glycol, which was obtained from Huntsman, and zinc acetate dehydrate, obtained from Aldrich Chemicals as the zinc salt. See Table 1 below. The resulting mixture was heated to 75° C. resulting in the formation of a complex of zinc and/or zinc hydroxide and the amino groups of the polyetheramine dispersed in the polyphenylsulfone. Upon further heating to above 110° C. as illustrated herein, the complex decomposes to form in situ nano-size zinc oxide particles present in a mixture of the polyetheramine and the polyphenylsulfone.

Example II

The process of Example I was repeated, except that carbon black was added, and the amounts of polyetheramine and zinc acetate were decreased, as recited in Table 1 below.

TABLE 1

| Sample | 20 Percent PPSU Resin in NMP, Grams | Carbon Black Dispersion, Grams | Zinc Acetate Dehydrate Used, Grams | JEFFAMINE ®, Grams Used |
|---|---|---|---|---|
| Example I | 10 | 0 | 0.2 | 0.2 |
| Comparative Example 1 | 20 | 2.17 | 0 | 0 |
| Example II | 10 | 1.1 | 0.1 | 0.1 |

The coating solutions of Example I and Example II were visually observed, and there was no settling or agglomeration of the Example I and Example II mixtures for one month, at which time the observation was discontinued versus settling and agglomeration of the solids of Comparative Example 1 after 5 days.

Intermediate transfer members were generated from the above prepared mixtures as follows.

The above formed coating solutions were applied by a 10 mil Bird bar on a stainless steel substrate of a thickness of about 25 microns. The resulting intermediate transfer members were then dried at 70° C. for 30 minutes, at 135° C. for 30 minutes, and at 190° C. for 45 minutes to, for example, remove water.

In the Table Examples I and II, in situ zinc oxide particles having a diameter of about 100 nanometers were formed in situ by allowing the zinc acetate and the polyetheramine to react, followed by drying the obtained mixture with heat at a temperature of about 175° C.

The Example I intermediate transfer member contained in situ formed zinc oxide as a conductive material; Comparative Example 1 contained only carbon black as a conductive material; and Example II initially contained 50 percent of zinc acetate and JEFFAMINE® ED-2083 and 50 percent of carbon black, and where the carbon black was present in the intermediate transfer member, an amount of 5 weight percent based on the weight percent of the nano-sized zinc oxide particles and the carbon black.

The transparency of each of the above intermediate transfer members were determined with a Perkin Elmer UV/VIS/NIR Spectrometer Lambda 19 at wavelengths of from 400 to 1,000 nanometers. Comparative Example 1 had a light absorption of only about 22 percent at 800 nanometers, while Examples I and II had about 95 percent and 97 percent light absorption at 800 nanometers, respectively.

Surface resistivity of the intermediate transfer members of Example I, Example II, and Comparative Example 1 were measured with the instrument Hiresta-UP, MCO-HT 450 available from Mitsubishi Chemical Corporations. The results at 1,000 volts are summarized in Table 2 below. The surface resistivity of Comparative Example 1 had a lower surface resistivity. Although Example II contains half the amount of zinc oxide as in Example I, and half the amount of carbon black as in Comparative Example 1, its surface resistivity was 1,000 times lower. This is a strong indication that there is an electrical synergistic effect between the zinc oxide and the polyetheramine, and that a much lower amount of zinc oxide and polyetheramine can be selected to achieve the desired surface resistivity for intermediate transfer members.

TABLE 2

| Samples | Surface Resistivity, Ω/□ |
|---|---|
| Example I | 2.34E+11 |
| Comparative Example 1 | 8.83E+09 |
| Example II | 8.80E+06 |

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A transparent intermediate transfer member consisting of an optional supporting substrate, a photoconductor and said intermediate transfer member and wherein there is transferred from said photoconductor to said intermediate transfer member a xerographic developed toner image and which member consists of a layer of a mixture of carbon black particles and nano-size zinc oxide present in a mixture of a polyarylsulfone, and a polyetheramine.

2. A member in accordance with claim 1 wherein an aryl of said polyarylsulfone contains from about 6 to about 18 carbon atoms, and said nano-size zinc oxide is of a diameter of from about 0.15 Angstrom to about 225 nanometers.

3. A member in accordance with claim 2 wherein said nano-size zinc oxide is of a diameter of from about 50 nanometers to about 250 nanometers, said aryl of said polyarylsulfone contains from 6 to about 12 carbon atoms, and said nano-sized zinc oxide is in the form of in-situ particles.

4. A member in accordance with claim 3 wherein said nano-size zinc oxide is of a diameter of from about 100 nanometers to about 250 nanometers, said polyarylsulfone is a polyphenylsulfone, said polyetheramine is water soluble aliphatic diamine derived from a propylene oxide capped polyethylene glycol, and said nano-sized zinc oxide is in the form of in-situ particles.

5. A member in accordance with claim 1 wherein said nano-size zinc oxide in the form of in situ particles are of a diameter of from about 100 nanometers to about 200 nanometers, said polyarylsulfone is a polyphenylsulfone, a polynapthylsulfone or a polyanthrylsulfone, and wherein said polyphenylsulfone, said polynapthylsulfone, or said polyanthrylsulfone is of a weight average molecular weight of from about 100 to about 125,000, and said polyetheramine is of a weight average molecular weight of from about 500 to about 100,000, said weight average molecular weights being determined by GPC analysis.

6. A member in accordance with claim 1 wherein said nano-size zinc oxide are generated by the reaction of zinc acetate, zinc chloride, zinc bromide, zinc fluoride, zinc iodide, zinc sulfide, or zinc nitrate with a polyetheramine thereby forming a complex with the amino groups of said polyetheramine, which upon heating causes the complex to decompose and from said in situ nano-size zinc oxide particles.

7. A member in accordance with claim 6 wherein said zinc oxide is present in an amount of from about 0.5 to about 15 weight percent.

8. A member in accordance with claim 1 wherein said supporting substrate is present and wherein said layer is in contact with said supporting substrate, and wherein the nano-size zinc oxide is in the form of in-situ particles of a diameter of from about 100 to about 200 nanometers.

9. A member in accordance with claim 8 wherein the supporting substrate comprises a polyimide, and said polyarylsulfone is a polyphenylsulfone.

10. A member in accordance with claim 1 wherein the nano-size zinc oxide is formed in situ by a reaction between a zinc salt and amino substituents of said polyetheramine.

11. A transparent intermediate transfer member consisting of a photoconductor and said intermediate transfer member and wherein there is transferred from said photoconductor to said intermediate transfer member a xerographic developed image and which member consists of a supporting substrate and a layer thereover of situ nano-size zinc oxide particles having a diameter of from about 50 to about 250 nanometers dispersed in a mixture of carbon black, a polyetheramine and a polyphenylsulfone and an optional outer release layer positioned on said layer comprising in situ nano-size zinc oxide particles.

12. A member in accordance with claim 11 wherein said nano-size zinc oxide particles are of a diameter of from about 100 to about 150 nanometers.

13. A member in accordance with claim 11 wherein said supporting substrate is a polyimide or a polyamideimide.

14. A member in accordance with claim 11 wherein said supporting substrate is a polyimide, and said in situ nano-size zinc oxide particles are of a diameter of from about 100 to about 175 nanometers.

15. A member in accordance with claim 11 wherein said outer release layer is present and which release layer consists of a material selected from the group consisting of a) fluorinated ethylene propylene copolymer, b) a polytetrafluoroethylene, c) a polyfluoroalkoxy polytetrafluoroethylene, d) a fluorosilicone, e) copolymers of two of vinylidene fluoride, hexafluoropropylene, and tetrafluoroethylene, f) terpolymers of vinylidene fluoride, hexafluoropropylene, and tetrafluoroethylene, g) tetrapolymers of vinylidene fluoride, hexafluoropropylene, tetrafluoroethylene, and a cure site monomer, and h) mixtures thereof.

16. A member in accordance with claim 11 wherein said transparent member absorbs light at from about 75 percent to about 90 percent in the wavelength region of from about 500 to about 800 nanometers, and said supporting substrate is a polymide of a thickness of from about 25 to about 75 microns.

17. A transparent intermediate transfer member comprising a photoconductor and said intermediate transfer member and wherein there is transferred from said photoconductor to said intermediate transfer member a xeroqraphic developed image and which member comprises a supporting substrate, a layer thereover comprising a mixture of in situ nano-size zinc oxide particles having a diameter of from about 100 to about 250 nanometers dispersed in a mixture of a polyetheramine and a polyphenylsulfone, and in contact with said in situ nano-sized zinc oxide mixture a release layer.

18. A member in accordance with claim 17 wherein the release layer is comprised of a material selected from the group consisting of a) fluorinated ethylene propylene copolymer, b) a polytetrafluoroethylene, c) a polyfluoroalkoxy polytetrafluoroethylene, d) a fluorosilicone, e) copolymers of two of vinylidene fluoride, hexafluoropropylene, and tetrafluoroethylene, f) terpolymers of vinylidene fluoride, hexafluoropropylene, and tetrafluoroethylene, and g) tetrapolymers of vinylidene fluoride, hexafluoropropylene, tetrafluoroethylene, and a cure site monomer.

19. A member in accordance with claim 17 wherein said transparent member absorbs light at from about 75 percent to about 90 percent in the wavelength region of from about 500 to about 800 nanometers, said supporting substrate is a polyimide of a thickness of from about 25 to about 75 microns.

20. A member in accordance with claim 1 wherein said transparent member absorbs light at from about 75 percent to about 90 percent in the wavelength region of from about 500 to about 800 nanometers.

* * * * *